US006744190B2

(12) United States Patent
Van Vroonhoven et al.

(10) Patent No.: US 6,744,190 B2
(45) Date of Patent: Jun. 1, 2004

(54) CATHODE RAY TUBE WITH MODIFIED IN-LINE ELECTRON GUN

(75) Inventors: Jozef Cornelis Walterus Van Vroonhoven, Eindhoven (NL); Johannes Theodorus Peerlings, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 90 days.

(21) Appl. No.: 10/024,771

(22) Filed: Dec. 20, 2001

(65) Prior Publication Data

US 2002/0079816 A1 Jun. 27, 2002

(30) Foreign Application Priority Data

Dec. 22, 2000 (EP) ..... 00204784

(51) Int. Cl.[7] ..... H01J 29/50

(52) U.S. Cl. ..... 313/409; 313/414; 313/441; 313/446

(58) Field of Search ..... 313/409, 414, 313/415, 441, 446, 447, 458, 460

(56) References Cited

U.S. PATENT DOCUMENTS 4,374,609 A * 2/1983 Lange ..... 359/455
6,479,937 B2 * 11/2002 Chen et al. ..... 315/14

OTHER PUBLICATIONS

Patent Abstracts of Japan, Kikuchi Norifumi, "Electron Gun For Color Cathode Ray Tube," Publication No. 11073892, Mar. 16, 1999, Application Date 09234606, Aug. 29, 1997.

* cited by examiner

*Primary Examiner*—Nimeshkumar D. Patel
*Assistant Examiner*—Kevin Quarterman

(57) ABSTRACT

Cathode ray tube having an electron gun which is modified with respect to the electron gun having three equidistant cathodes lying "in line". The cathode for generating the green (central) beam is offset with respect to its position in an in-line gun, and the grids in the focus and/or triode part of the gun have been modified to provide at least one kink in the trajectory of the green beam to restore convergence.

15 Claims, 3 Drawing Sheets

CATHODE RAY TUBE WITH MODIFIED IN-LINE ELECTRON GUN

BACKGROUND OF THE INVENTION

The invention relates to a cathode ray tube having a longitudinal axis, a phosphor screen, an electron gun arranged around the longitudinal axis, the electron gun comprising a triode part having three cathodes for generating a red, a green and a blue electron beam, respectively, and two common grids arranged transversely to the longitudinal axis, and a focus lens part having at least two common grids arranged transversely to the longitudinal axis.

Normally, a cathode ray tube for television or other purposes has an envelope with a large bulb portion and a tubular neck portion fixed thereto. A plurality of electrodes for forming and focusing electron beams along a path extending into the bulb portion is mounted within the tubular neck portion. Magnetic or electrostatic field-producing means are used for moving the electron beams in any desired manner over a wall portion or face plate of the envelope bulb portion. The inner surface of the wall or face plate is coated with a film of phosphor material which luminesces with a visible light when struck by the electron beams. By modulating the current of the electron beams, the scanned area of the phosphor screen can be varied in a manner to produce a light path in accordance with modulating signals applied to the electron gun of the tube.

When using a CRT during the manufacture of, e.g. a television set or a monitor, the setmaker has to set the white point. It turns out, however, that the white point of the finalized apparatus is sometimes shifted and displayed images become discolored.

SUMMARY OF THE INVENTION

It is an object of the present invention to provide a cathode ray tube which allows a display to have a substantially stable white point during its life.

The cathode ray tube in accordance with the invention is characterized in that the cathode for generating the green electron beam is offset from the longitudinal axis, the electron gun being capable of having the green electron beam in the center of the phosphor screen.

The invention is based on the recognition that initially, during the adjustments of the cathode ray tube apparatus, the "green" cathode has a temporary loss of emission due to residual gases being present inside the tube and due to ionization of the gas atoms leading to bombardment of the cathode surfaces with positive ions. The emission improves substantially after one or two hours of tube operation (scanning aging or raster aging, also called the soak test). As a result, the white point is shifted and displayed images become greener.

The reason why the "green" cathode suffers more severely from loss of emission than the "red" and "blue" cathodes can be explained by the presence of kinks in the "red" and "blue" electron beams in the neighborhood of grid G3*a*, necessary for convergence of the three beams. For reasons of symmetry (concerning electron guns with in-line cathodes), such a kink is not present in the "green" electron beam.

The unequal amounts of emission loss for the "red" and "blue" cathodes, on the one hand, and the "green" cathode, on the other hand, lead to discoloration of the displayed images. Therefore, the object of this invention is to obtain a new electron gun design for which the three cathodes are equally exposed to ion bombardment and thus suffer from emission loss with equal severity. This can be achieved by introducing a kink in the "green" electron beam too.

This kink can be constructed analogously to the kinks in the "red" and "blue" electron beams in either the horizontal direction or the vertical direction. This idea is worked out below for the cathode positions and for the positions of the grid apertures, where a slight offset from the longitudinal axis (z-axis), or from the original in-line plane (the x-z plane) is considered. A delta orientation of the three cathodes can also be considered.

The kink in the "green" beam requires an electron-gun design in which apertures are made for the green beam in the G2 and/or in the G3*a*-grid, which are eccentric with respect to the apertures in the G1 grid.

These and other aspects of the invention are apparent from and will be elucidated with reference to the embodiments described hereinafter.

BRIEF DESCRIPTION OF THE DRAWINGS

In the drawings

The Figures are purely diagrammatic and not to scale. For the sake of clarity, some dimensions are exaggerated. Corresponding components in the Figures have been given identical reference numerals as much as possible.

DESCRIPTION OF PREFERRED EMBODIMENTS

Figure 1:
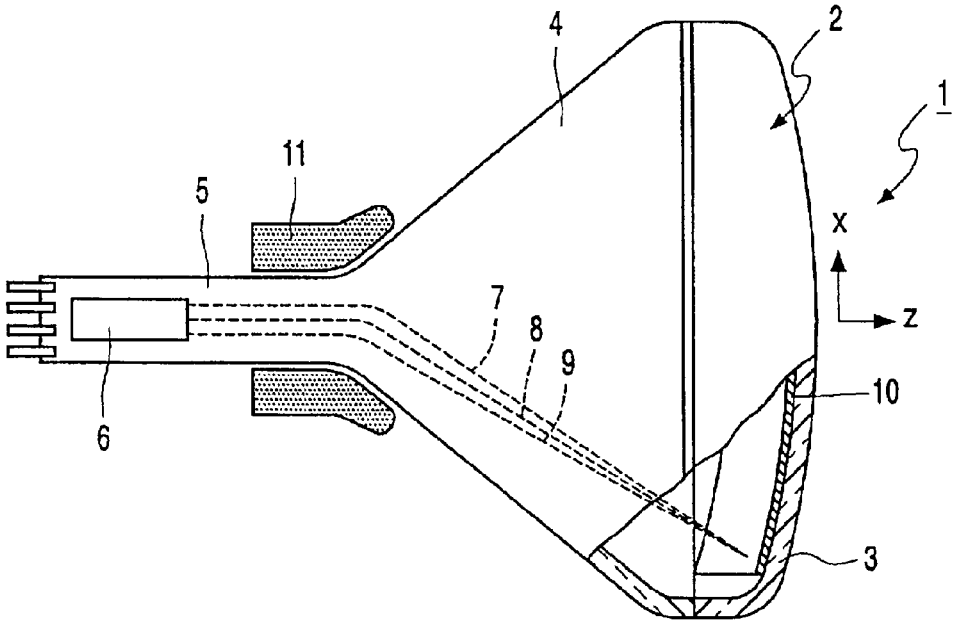
FIG. 1 is a diagrammatic cross-section of an embodiment of a cathode ray tube for a picture display device.

The cathode ray tube shown in FIG. 1 is a color cathode ray tube 1 having an evacuated envelope 2 comprising a display window 3, a cone 4 and a neck 5. The neck 5 accommodates an electron gun 6 for generating three electron beams 7, 8 and 9 extending, in this embodiment, in one plane. A display screen 10 is situated on the inner side of the display window 3. The display screen 10 comprises a plurality of red, green and blue-luminescing phosphor elements. Each group of (red, green or blue) phosphor elements forms a pattern. The display screen may alternatively comprise other patterns such as a black matrix (a black pattern) or color filter patterns. On their way to the display screen 10, the electron beams 7, 8 and 9 are deflected across the display screen 10 by means of a deflection unit 11. The arrow Z represents the direction of the longitudinal axis of the tube 1, and the arrow X represents the direction of the longitudinal axis of the display screen 10. Conventional electron guns of the in-line type have three cathodes which lie in one plane and generate three electron beams lying in that plane (generally the X-Z plane). The cathodes in that case have a configuration in accordance with FIG. 2*a*, the green cathode being aligned with the Z-axis.

During operation of the tube, gas atoms present inside the tube can be ionized by high-velocity electrons. Positive ions, like argon ions, travel in the reverse direction of the electrons generated by the cathodes under the action of the electric field.

Bombardment of the cathode surface with positive ions can lead to (temporary or permanent) loss of emission if the area of bombardment and the emitting area coincide. If the loss of emission is not equal for the three cathodes, the problem of white point shift occurs.

The "kinks" present in the trajectories of the red and blue electron beams (needed for convergence) have the additional effect that in tubes with a conventional in-line configuration, where the trajectory of the green electron beam does not have a "kink", the emitting areas of the red and blue cathode are less exposed to ion bombardment than the emitting area of the green cathode, and consequently suffer reduced emission losses.

Figure 2:
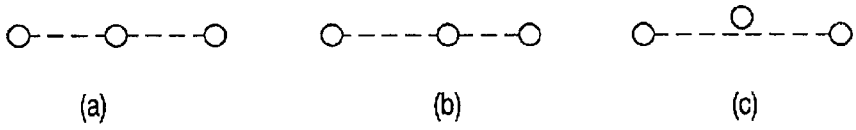
FIG. 2 shows the positions of the cathodes (and grid apertures) in: (a) a current in-line configuration, (b) the "green" cathode shifted in the horizontal direction, and the "green" cathode shifted (c) in the vertical direction.
Figure 3:
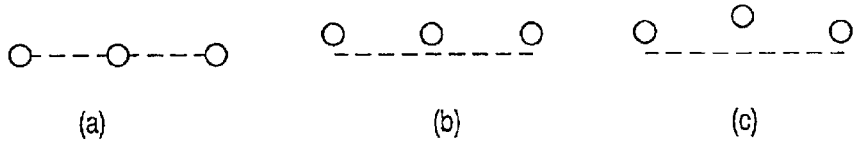
FIG. 3 shows the positions of the cathodes (and grid apertures) in: (a) a current in-line configuration, (b) the three cathodes shifted in the vertical direction by equal amounts, and (c) the green cathode shifted more in the vertical direction than the red and blue cathodes.

Introducing a kink in the "green" electron beam will solve the above problem. This kink can be constructed analogously to the kinks in the "red" and "blue" electron beams by a translation of the "green" apertures in the triode grids in either the horizontal or the vertical direction. This is shown in FIG. 2 for the positions of the cathodes and the grid apertures. A delta orientation of the three cathodes can also be considered. Also, a translation of the three cathodes in the vertical direction can be considered, as is shown in FIG. 3. In FIGS. 2 and 3, the dotted line represents the original in-line plane (X-Z plane), and FIGS. 2*a* and 3*a* represent the conventional "3-in-line" cathode configuration in which the central (green) beam goes straight to the phosphor screen, without a kink in its trajectory. In the other configurations, a kink is involved. The applicability and effectiveness of these kinks plus the magnitude of the translation of the green beam depend on the specific tube and electron gun.

In accordance with configuration 2*b*, the central (green) cathode is slightly offset in the vertical direction from the original in-line plane. In tubes with smaller neck diameters, configuration 1(*b*) cannot give the desired effect completely, because there is insufficient space to shift the "green" cathode, and because the convergence of the electron beams is disturbed.

In this respect, a delta configuration (not shown) is even less attractive. Configuration 2*c*, in which the central (green) cathode is slightly offset from the longitudinal axis in the vertical direction has a better applicability.

The configurations shown in FIGS. 3*b* and 3*c* appear to be the more interesting ones.

In FIG. 3*b*, the plane of the three cathodes is offset from the original in-line plane. In FIG. 3*c*, the plane of the three cathodes is offset from the original in-line plane, and the central (green) cathode has an additional offset in the vertical direction.

The configurations shown in FIGS. 2*b*, 2*c*, 3*b* and 3*c* involve a kink in the trajectory of the green beam.

Figure 4:
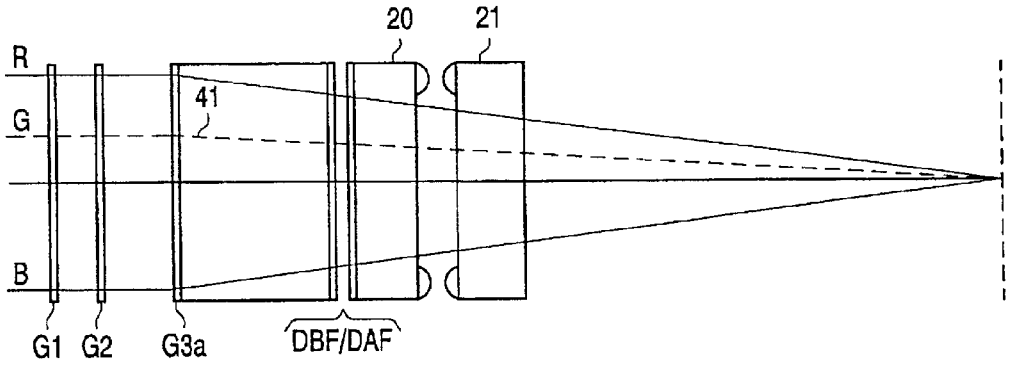
FIGS. 4, 5 and 6 are schematic views of electron guns with three electron beams in which the green beam is kinked in three different manners.

FIG. 4 schematically shows an electron gun in which the trajectory of the electron beam 41 generated by the green cathode G gets a kink in grid G3*a* for convergence with the red and blue beams in the center of the screen.

However, when the kink is created in the G3*a* section of the electron gun, as is the case for "red" and "blue", the "green" electron beam will pass asymmetrically through the main lens. This may cause convergence problems because the deflection unit has been designed for in-line electron guns and is usually self-converging.

A further modification of the current concept of an in-line electron gun/deflection unit concept may therefore be necessary.

Figure 5:
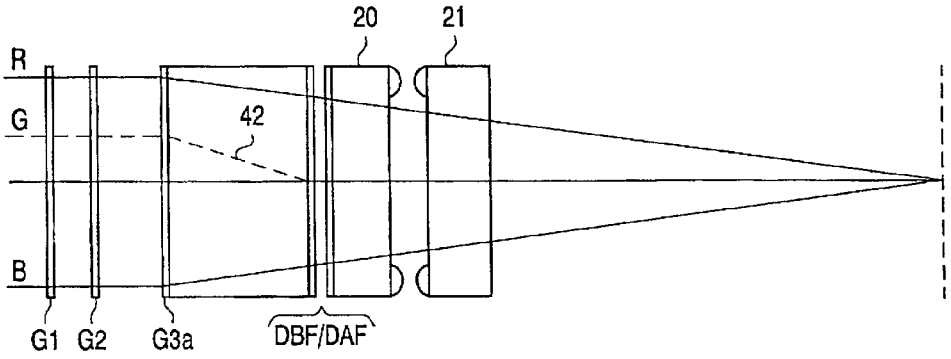

An alternative is shown in FIG. 5, where the trajectory of the green beam 42 has two kinks, one near grid 3A in the pre-focusing section, and one before entering the area of the main lens 20, 21 e.g. in the DAF or DAF-DBF section, such that the green beam passes straight through the center of the main lens 20, 21. This may overcome convergence problems.

The kink near grid G3*a* in the prefocusing section is not much susceptible to the variation of the dynamic focusing potential, because the potential difference between grids G2 and G3*a* is of the order of several kV. Creating a kink in the DAF or DBF sections is more difficult, because the potential differences over these gaps vary between −300 and 1000V. Of course, this only applies to DAF and DAF-DBF guns and not to non-DAF electron guns.

Figure 6:
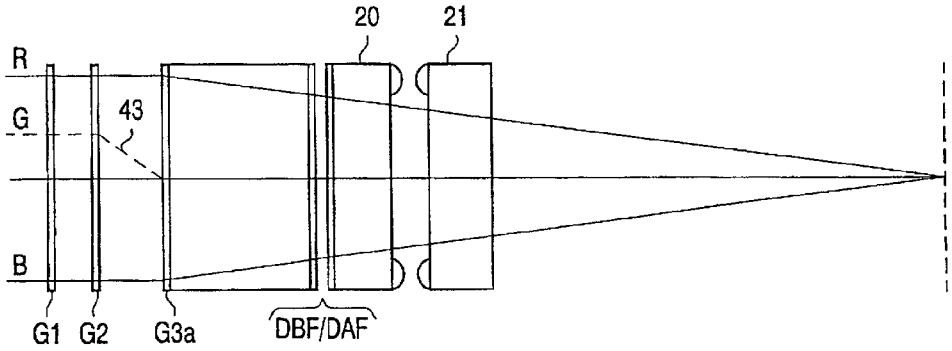

Another alternative, shown in FIG. 6, is creating a first kink in the triode section between grids G1 and G2, and a second kink near grid G3*a*. Also, in this case, the green beam 43 passes through the center of the main lens 20, 211.

It is noted that the term DAF is used in the prior art to indicate a dynamic astigmatism focus lens and the term DBF is used to indicate a dynamic beam focus lens.

It is further noted that in e.g. conventional electron guns of the three-in-line type, the pitch of the outer grid apertures (the apertures for the red and the blue beam) in the triode part is 6.020 mm and the pitch of the outer apertures in grid G3*a* is 5.080 mm. The desired "kink" in the trajectories of the red and the blue beam is achieved by this "eccentricity". In an analogous manner a kink can be achieved in the trajectory of the central (green) beam.

In summary, the invention relates to a cathode ray tube having an electron gun which is modified with respect to the electron gun having three equidistant cathodes lying "in line". The cathode for generating the green (central) beam is offset with respect to its position in an in-line gun, and the grids in the focus and/or triode part of the gun have been modified to provide at least one kink in the trajectory of the green beam to restore convergence.

As cathodes of the impregnated type, so-called I-cathodes, are particularly sensitive to ion bombardment, the invention is particularly suitable for use in CRTs which are equipped with I-cathodes.

What is claimed is:

1. A cathode ray tube having a longitudinal axis, a phosphor screen, and an electron gun arranged around the longitudinal axis, wherein the electron gun comprises a triode part having three cathodes for generating a red electron beam, a green electron beam and a blue electron beam, a pro-focusing grid having a green beam aperture, a red beam aperture, and a blue beam aperture, and a focus lens part having at least two common grids with green beam, red beam and blue beam apertures, wherein the cathode for generating the green electron beam is offset from the longitudinal axis, wherein a green beam aperture in the focus lens is eccentric with respect to the green aperture in the pro-focusing grid; and wherein the pre-focusing grid and the focus lens are configured such that a trajectory of the green electron beam has a kink adjacent the pro-focusing grid so as to pass through the focus lens.

2. A cathode ray tube as claim in claim 1, wherein the green cathode lies in one plane with the red and the blue cathodes, said plane including the longitudinal axis.

3. A cathode ray tube as claimed in claim 1, wherein the green cathode lies in one plane with the red and the blue cathode, said plane being parallel to, and spaced apart from, the longitudinal axis.

4. A cathode ray tube as claimed in claim 1, wherein the red and the blue cathodes lie in one plane, and wherein the green cathode is spaced apart from said plane.

5. A cathode ray tube as claimed in claim 4, wherein said plane is parallel to, and spaced apart from, the longitudinal axis.

6. A cathode ray tube as claimed in claim 1, wherein the focus lens parts provide a kink in the trajectory of the green beam.

7. A cathode ray tube as claimed in claim 6, wherein a first kink is produced in the area around the pre-focusing grid.

8. A cathode ray tube as claimed in claim 6, wherein a second kink is produced in the area around that-the focus lens parts.

9. A cathode ray tube as claimed in claim 6, wherein a first kink is produced near a common grid and a second kink is produced near the pre-focusing grid.

10. A cathode ray tube having a longitudinal axis, three cathodes for generating a red, a green and a blue electron beams, a pre-focusing grid having a red, green, and blue beam apertures, a common grid disposed between the three cathodes and the pre-focusing grid, and a focus lens having red, green, and blue apertures;

wherein the cathode for generating the green electron beam is offset from the longitudinal axis, wherein a green beam aperture in the focus lens is eccentric with respect to the green aperture in the pre-focusing grid; and wherein a generated green electron beam trajectory has a kink adjacent the pre-focusing grid.

11. A cathode ray tube according to claim 10, wherein the green electron beam trajectory has a kink adjacent the common grid.

12. A cathode ray tube according to claim 11, wherein the green electron beam trajectory passes through the center of the focus lens.

13. A cathode ray tube according to claim 10, wherein the green electron beam trajectory has a kink adjacent the focus lens.

14. A cathode ray tube as claim in claim 10 wherein the three cathodes lie in the same plane.

15. A cathode ray tube as claimed in claim 10, wherein the cathode for producing the green beam is not coplanar with the cathodes for producing the red and blue beams.

* * * * *